US005234514A

United States Patent [19]

Donahue et al.

[11] Patent Number: 5,234,514

[45] Date of Patent: Aug. 10, 1993

[54] HYPEREUTECTIC ALUMINUM-SILICON ALLOY HAVING REFINED PRIMARY SILICON AND A MODIFIED EUTECTIC

[75] Inventors: Raymond J. Donahue, Fond du Lac; William G. Hesterberg, Rosendale; Terrance M. Cleary, Allenton, all of Wis.

[73] Assignee: Brunswick Corporation, Skokie, Ill.

[21] Appl. No.: 702,895

[22] Filed: May 20, 1991

[51] Int. Cl.[5] ..... C22C 21/02; C22C 21/04

[52] U.S. Cl. ..... 148/549; 148/698; 148/700; 148/702; 148/438; 148/439; 148/440; 420/548; 420/546; 420/534

[58] Field of Search ..... 148/159, 3, 415, 416, 148/417, 437, 438, 439, 440, 549, 698, 702; 420/548

[56] References Cited

U.S. PATENT DOCUMENTS

| | | | |
|---|---|---|---|
| 4,113,473 | 9/1978 | Gauvry et al. | 420/548 |
| 4,603,665 | 8/1987 | Hesterberg et al. | 123/195 |
| 4,821,694 | 4/1989 | Hesterberg et al. | 123/195 |
| 4,902,475 | 2/1990 | Apelain et al. | 420/548 |
| 4,966,220 | 10/1990 | Hesterberg et al. | 164/34 |
| 4,969,428 | 11/1990 | Donahue et al. | 123/195 |

OTHER PUBLICATIONS

Bakurdzhiev, I.; Kovachev, V.; Vangelov, A. "Study of the effect of complex alloying and modification on the mechanical properties of a hypereutectic aluminum-ailicon alloy at elevated temperatures", Mashinostroene, 29(12), 538–41, 1980 (only abstract is disclosed).

*Primary Examiner*—R. Dean
*Assistant Examiner*—Sikyin Ip
*Attorney, Agent, or Firm*—Andrus, Sceales, Starke & Sawall

[57] ABSTRACT

A hypereutectic aluminum-silicon casting alloy having a refined primary silicon particle size and a modified silicon phase in the eutectic. The aluminum base alloy includes from 19% to 30% by weight of silicon and also contains 0.005% to 0.06% by weight of phosphorus, and 0.15% to 1.15% by weight of titanium. On cooling from solution temperature, the phosphorus serves as an active nucleant for the primary silicon phase, while at a lower temperature, a titanium-aluminum intermetallic compound is formed that is sheathed by the pseudoprimary $\alpha$-aluminum and the sheathed particles act as a nucleant to modify the acicular silicon phase in the eutectic. The resulting alloy has primary silicon refinement coupled with eutectic silicon modification.

6 Claims, No Drawings

HYPEREUTECTIC ALUMINUM-SILICON ALLOY HAVING REFINED PRIMARY SILICON AND A MODIFIED EUTECTIC

BACKGROUND OF THE INVENTION

Aluminum silicon alloys containing less than about 11.6% by weight of silicon are referred to as hypoeutectic alloys, while alloys containing more than 11.6% silicon are referred to as hypereutectic alloys. The solidification range, which is a temperature range over which the alloy will solidify, is the range between the liquidus temperature and the invariant eutectic temperature. The wider or greater the solidification range, the longer it will take an alloy to solidify at a given rate of cooling.

Hypoeutectic aluminum silicon alloys, those containing less than 1.16% silicon, have seen use for many years. The unmodified alloys have a microstructure consisting of primary aluminum dendrites with a eutectic composed of acicular silicon in an aluminum matrix.

On the other hand, hypereutectic aluminum-silicon alloys, those containing more than 11.6% silicon, contain primary silicon crystals which are precipitated as the alloy is cooled from solution temperature. Due to large precipitated primary silicon crystals, these alloys have good wear resistant properties, but the hypereutectic aluminum-silicon alloys are difficult to machine, a condition which limits their use as casting alloys. While alloys of this type have good fluidity, they have a large or wide solidification range, and the solidification range will increase dramatically as the silicon content is increased.

Normally a solid phase in a "liquid plus solid" field, has either a lower or higher density than the liquid phase, but almost never the same density. If the solid phase is less dense than the liquid phase, floatation of the solid phase will result. On the other hand, if the solid phase is more dense, a settling of the solid phase will occur. In either case, an increased or widened solidification range will increase the time period for solidification and accentuate the phase separation. With a hypereutectic aluminum-silicon alloy, the silicon particles have a lesser density than the liquid phase, so that the floatation condition prevails, and the alloy solidifies with a large mushy zone, because of its high thermal conductivity, and the absence of skin formation typical of steel castings. Thus, as the solidification range is widened, the tendency for floatation of large primary silicon particles increases, thus resulting in a less uniform distribution of silicon particles in the cast alloy.

A wide solidification range can also result in significant amounts of microporosity, because the wide mushy zone does not permit good feeding of the liquid aluminum phase as it solidifies and shrinks about 6.9% in volume. When the cast alloy is used as an engine block, the microporosity results in high oil consumption in a four-stroke engine.

Hypereutectic aluminum-silicon alloys containing precipitated primary silicon crystals have had commercial applicability only because of the refinement of the primary silicon phase by phosphorus additions to the melt, as disclosed in U.S. Pat. No. 1,387,900. The addition of small amounts of phosphorous causes a precipitation of aluminum-phosphorous particles, which serve as the active nucleant for the primary silicon phase. Due to the phosphorous refinement, the primary silicon particles are of smaller size and have a more uniform distribution, so that the alloys can be used in applications requiring the manufacturing attribute of machinability and the engineering attribute of wear resistance. However, phosphorous refined alloys of this type do not have any significant level of ductility and thus are not used in more diverse engineering applications, requiring machinability, wear resistance, and ductility.

Hypoeutectic aluminum-silicon alloys, those containing less than 11.6% silicon, are relatively non-ductile or brittle because of the large irregular shape of the acicular eutectic silicon phase. It has been recognized that the growth of the eutectic silicon phase can be modified by the addition of small amounts of sodium or strontium, thereby increasing the ductility of the hypoeutectic alloy.

Therefore, while it is known that the primary silicon phase in a hypereutectic aluminum silicon alloy can be refined by the addition of phosphorous and it is further known that the eutectic silicon phase in a hypoeutectic aluminum silicon alloy can be modified with sodium or strontium, it is not possible to include both the additions of phosphorous and sodium or strontium in a hypereutectic alloy, since sodium and strontium neutralize the phosphorous effect. Thus, there has been no commercially available hypereutectic aluminum-silicon alloy with both a refined primary silicon phase and a modified eutectic silicon phase.

SUMMARY OF THE INVENTION

The invention is directed to a hypereutectic aluminum silicon casting alloy having both a refined primary silicon phase and a modified eutectic silicon phase. The alloy contains by weight from 19% to 30% silicon, 0.3% to 1.6% magnesium, less than 0.37% copper, less than 0.3% manganese, less than 0.4% iron, 0.005% to 0.06% phosphorous, 0.15% to 1.15% titanium, and the balance aluminum.

As the alloy is cooled from solution to a temperature below the liquidus temperature, the phosphorus acts in a conventional manner as a nucleating agent to cause precipitation of aluminum-phosphorous particles that serve as the active nucleant for the primary silicon phase, thus producing refined primary silicon particles having a size less than about 30 microns.

As the peritectic temperature associated with the formation of the titanium-aluminum intermetallic compound is about 1220° F. for alloys containing 22% silicon, more than 100° F. below the liquidus temperature, the nucleation of primary silicon occurs without any competitive or neutralizing events.

As the alloy is further cooled to the peritectic temperature of 1220° F., the titanium aluminum compound is formed which is sheathed by a pseudoprimary $\alpha$-aluminum which serves as the nucleant for the acicular silicon phase in the eutectic, thus resulting in a modification of the silicon phase of the eutectic.

Thus, the invention provides a hypereutectic aluminum-silicon alloy having both a refined primary silicon phase and a modified silicon phase in the eutectic. This results in a casting alloy having high wear resistance and also having increased ductility which improves the machinability of the alloy. The alloy has particular use as an engine block or other component of internal combustion engines.

DESCRIPTION OF THE PREFERRED EMBODIMENT

The hypereutectic aluminum-silicon casting alloy of the invention has the following formulation weight percent:

| | |
|---|---|
| Silicon | 19.0%-30.0% |
| Magnesium | 0.30%-1.6% |
| Copper | Less than 0.37% |
| Manganese | Less than 0.3% |
| Iron | Less than 0.4% |
| Phosphorous | 0.005%-0.06% |
| Titanium | 0.15%-1.15% |
| Aluminum | Balance |

The preferred composition of the alloy in weight percent is as follows:

| | |
|---|---|
| Silicon | 22.0%-28.0% |
| Magnesium | 0.4%-1.3% |
| Copper | Less than 0.25% |
| Manganese | Less than 0.2% |
| Iron | Less than 0.2% |
| Phosphorous | 0.01%-0.04% |
| Titanium | 0.15%-1.15% |
| Aluminum | Balance |

The microstructure of the alloy of the invention consists of artificially precipitated induced crystals of primary silicon with a eutectic composed of a modified silicon in an aluminum matrix.

In a conventional hypereutectic aluminum-silicon alloy, the primary silicon crystals are relatively large having a size generally greater than 30 microns, and the acicular silicon in the eutectic is relatively large and irregular in shape, rendering the alloy brittle. The invention is based on the concept of refining or reducing the size of the primary silicon particles, as well as modifying or reducing the physical size of the acicular silicon in the eutectic to provide a more ductile, wear resistant alloy, which has increased machinability.

With a typical hypereutectic aluminum silicon alloy, the solidification range, which is the temperature range over which the alloy will solidify, is increased as the silicon content increases. The wider or greater the solidification range, the longer it will take for an alloy to solidify at a given rate of cooling.

With a hypereutectic aluminum silicon alloy, the precipitated silicon particles have a lesser density than the liquid phase, resulting in the floatation of the silicon particles. As the solidification range is widened, the tendency for floatation of silicon particles increases, thus resulting in a less uniform distribution of silicon particles in the cast alloy. By maintaining the copper content at a value below 0.37%, and incorporating only minimum amounts of the relatively heavy metals, such as manganese and iron, which are present in the liquid phase during precipitation of the primary silicon, the differential in density between the precipitated primary silicon phase and the liquid is narrowed, so that the tendency for floatation and segregation is reduced.

When the alloy of the invention is cooled from solid solution to a temperature beneath the liquidus temperature, which is about 1364° F. for the 22% silicon alloy, the phosphorous acts in a conventional manner to cause precipitation of aluminum-phosphorous particles, which serve as an active nucleant for primary silicon, thus producing smaller refined primary silicon particles having a size generally less than 30 microns.

The titanium will also react with the aluminum to produce titanium-aluminum particles, but the peritectic temperature associated with the titanium-aluminum formation is about 1220° F., more than 100° F. beneath the liquidus temperature. Thus, the nucleation of primary silicon occurs without any competitive or neutralizing events. As the titanium will not react with the phosphorous, the titanium addition will not neutralize or adversely effect the nucleating action of the phosphorous.

As the alloy is further cooled to the peritectic temperature associated with the titanium-aluminum formation, the titanium-aluminum particles are formed which are sheathed by pseudo-primary $\alpha$-aluminum, which serves as a nucleant for the acicular silicon phase of the eutectic. This results in a modified acicular silicon phase resulting in smaller, more regular shaped silicon particles in the eutectic.

To obtain both the refined primary silicon and the modified silicon phase of the eutectic, it is important that the primary silicon be formed under conditions favorable for a good frequency of nucleation of the aluminum phosphorous compound without interference from other nucleations. Subsequently the second nucleant for the acicular silicon of the eutectic is formed. To achieve this independent and successive nucleation, it is necessary that the liquidus temperature be substantially above the peritectic reaction temperature for the formation of the titanium-aluminum particles, and preferably about at least 100° F. above the peritectic reaction temperature. The importance of the alloy having a liquidus temperature substantially above the peritectic reaction temperature is illustrated by the following examples:

EXAMPLE I

An alloy was prepared having the following composition in weight percent:

| | |
|---|---|
| Silicon | 25.00% |
| Magnesium | 0.70% |
| Manganese | 0.20% |
| Copper | 0.16% |
| Iron | 0.12% |
| Phosphorous | 0.04% |
| Titanium | 0.20% |
| Aluminum | Balance |

The liquidus temperature of the above alloy was 1400° F., 180° F. above the peritectic temperature associated with the formation of titanium aluminum particles, which is 1220° F.

On cooling from solution temperature to the liquidus temperature, aluminum phosphorous particles were formed and served as nucleants for the primary silicon particles. The frequency of nucleation of the aluminum phosphorous particles had ample time to be established unimpeded by any neutralizing, poisoning or competitive precipitating events throughout the range of temperature from 1400° F. to 1220° F.

At cooling below 1220° F., the titanium aluminum particles were formed, sheathed by pseudoprimary $\alpha$-aluminum, which serves as the nucleant for the silicon phase in the eutectic.

The final microstructure for the 25% silicon alloy exhibit both a refined primary silicon phase having an average particle size less than 30 microns and modified silicon phase in the eutectic.

EXAMPLE II

A hypereutectic aluminum-silicon alloy was prepared having the following composition in weight percent:

| | |
|---|---|
| Silicon | 16.0% |
| Magnesium | 0.55% |
| Manganese | 0.21% |
| Iron | 0.11% |
| Copper | 0.15% |
| Phosphorous | 0.04% |
| Titanium | 0.20% |
| Aluminum | Balance |

The liquidus temperature of this alloy containing 16% silicon was 1148° F. and since the peritectic temperature associated with the formation of the titanium aluminum particles is 1220° F., the pseudoprimary α-aluminum nucleant will form before the aluminum-phosphorous nucleant on cooling of the alloy from solution temperature.

At 1148° F. primary silicon forms, but the frequency of nucleation is poor, due to the interference of the previous competitive precipitation of the titanium aluminum particles.

The final microstructure for the 16% silicon alloy exhibits a poorly refined primary silicon phase having a particle size generally greater than 40 microns and a modified eutectic.

These examples illustrate the importance of first forming the primary silicon particles under conditions favorable for a good frequency of nucleation of aluminum phosphorous particles and subsequently forming the second nucleant for the silicon phase of the eutectic in order to obtain both a refined primary silicon and a modified eutectic.

The invention provides a hypereutectic aluminum silicon casting alloy having both refined primary silicon particles and a modified silicon phase in the eutectic. This results in a casting alloy having excellent wear resistance and good machinability along with increased ductility and impact resistance.

The alloy of the invention can be used for a wide variety of products, particular those requiring high wear resistance. The alloy has particular use in casting engine blocks and other engine components of internal combustion engines.

Various modes of carrying out the invention are contemplated as being within the scope of the following claims particularly pointing out and distinctly claiming the subject matter which is regarded as the invention.

We claim:

1. A hypereutectic aluminum-silicon casting alloy consisting essentially of 19% to 30% by weight of silicon, 0.03% to 1.6% by weight of magnesium, less than 0.37% by weight of copper, less than 0.03% by weight of manganese, less than 0.04% by weight of iron, 0.005% to 0.06% by weight of phosphorous, 0.15% to 1.15% by weight of titanium, and the balance aluminum, said alloy having a liquidus temperature above the peritectic temperature for the formation of titanium-aluminum particles, said alloy having a metallographic structure consisting of refined primary silicon particles and a modified silicon phase in the eutectic.

2. The alloy of claim 1, wherein said liquidus temperature is at least 100° F. above said peritectic temperature.

3. The alloy of claim 1, wherein the silicon content is in the range of 22% to 28% by weight.

4. The alloy of claim 1, wherein the refined silicon particles have an average particle size less than 30 microns.

5. A method of producing a hypereutectic aluminum-silicon casting alloy, comprising the steps of preparing an alloy having the following composition in weight percent:

| | |
|---|---|
| Silicon | 19.0%-30.0% |
| Magnesium | 0.3%-1.6% |
| Copper | Less than 0.37% |
| Manganese | Less than 0.03% |
| Iron | Less than 0.04% |
| Phosphorous | 0.005%-0.06% |
| Titanium | 0.15%-1.15% |
| Aluminum | Balance, |

said alloy having a liquidus temperature substantially above the peritectic temperature for the formation of titanium-aluminum particles, heating said alloy to solution temperature, cooling said alloy below the liquidus temperature to produce aluminum-phosphorous particles and thereby nucleate primary silicon crystals, further cooling the alloy after nucleation of said primary silicon crystals to a temperature below said peritectic temperature to form titanium-aluminum particles sheathed with α-aluminum and thereby nucleate the silicon of the eutectic to provide a modified silicon phase in the eutectic.

6. A hypereutectic aluminum-silicon casting alloy consisting essentially of 19% to 30% by weight of silicon, 0.03% to 1.6% by weight of magnesium, less than 0.37% by weight of copper, less than 0.03% by weight of manganese, less than 0.04% by weight of iron, 0.005% to 0.06% by weight of phosphorous, 0.15% to 1.15% by weight of titanium, and the balance aluminum, said phosphorous acting as a nucleant for precipitated primary silicon to thereby refine the size of said primary silicon particles, said titanium acting as a second nucleating agent characterized by the ability to react with said aluminum to form an aluminum-titanium intermetallic nucleant for the silicon phase of the eutectic to thereby modify said silicon phase, said alloy having a liquidus temperature above the peritectic temperature for the formation of said intermetallic nucleant.

* * * * *